US012251616B2

(12) United States Patent
Neuhaus et al.

(10) Patent No.: US 12,251,616 B2
(45) Date of Patent: Mar. 18, 2025

(54) PACING LIGHTING SYSTEM FOR STRENGTH TRAINING APPARATUS

(71) Applicant: OxeFit, Inc., Plano, TX (US)

(72) Inventors: Peter Neuhaus, Pensacola Beach, FL (US); Tyson Cobb, Pensacola, FL (US)

(73) Assignee: OxeFit, Inc., Plano, TX (US)

( * ) Notice: Subject to any disclaimer, the term of this patent is extended or adjusted under 35 U.S.C. 154(b) by 0 days.

(21) Appl. No.: 18/427,285

(22) Filed: Jan. 30, 2024

(65) Prior Publication Data

US 2024/0165486 A1 May 23, 2024

Related U.S. Application Data

(63) Continuation of application No. 17/010,573, filed on Sep. 2, 2020, now Pat. No. 11,918,884.

(51) Int. Cl.

| | |
|---|---|
| ***A63B 71/06*** | (2006.01) |
| ***A63B 21/078*** | (2006.01) |
| ***A63B 24/00*** | (2006.01) |

(52) U.S. Cl.

CPC ..... *A63B 71/0686* (2013.01); *A63B 21/078* (2013.01); *A63B 24/0062* (2013.01); *A63B 71/0622* (2013.01); *A63B 2024/0093* (2013.01); *A63B 2220/20* (2013.01); *A63B 2220/803* (2013.01)

(58) Field of Classification Search

CPC ..... A63B 71/0686; A63B 21/078; A63B 24/0062; A63B 71/0622; A63B 2024/0093; A63B 2220/20; A63B 2220/803; A63B 33/002; A63B 23/0405; A63B 2023/0411; A63B 2071/0694; A63B 2220/10; A63B 2220/805; A63B 2225/20; A63B 2225/50; A63B 2230/04; A63B 2230/045; A63B 21/0058; A63B 21/153; A63B 2225/74; A63B 2230/207

See application file for complete search history.

(56) References Cited

U.S. PATENT DOCUMENTS

| | | | |
|---|---|---|---|
| 4,702,475 | A | 10/1987 | Elstein et al. |
| 4,778,175 | A | 10/1988 | Wucherpfennig et al. |
| 4,817,940 | A | 4/1989 | Shaw et al. |
| 4,827,257 | A | 5/1989 | Kortegaard |
| 4,907,795 | A | 3/1990 | Shaw et al. |
| 6,086,379 | A | 7/2000 | Pendergast et al. |
| 7,666,118 | B1 | 2/2010 | Anthony |
| 7,824,309 | B1 | 11/2010 | Tadlock |
| 8,602,945 | B1 | 12/2013 | Haubrich |
| 9,446,288 | B1 | 9/2016 | Pazan |

(Continued)

OTHER PUBLICATIONS

U.S. Appl. No. 16/909,003, filed Jun. 23, 2020, Oxefit, Inc.

(Continued)

*Primary Examiner* — Sundhara M Ganesan
(74) *Attorney, Agent, or Firm* — Foley & Lardner LLP

(57) ABSTRACT

A strength training apparatus includes a rack configured to hold a bar between exercises performed using the bar, at least one light source coupled to the rack, and a controller communicable with the light sources. The controller is programmed to determine a desired range of motion for a current exercise and control the at least one light source to display an illumination pattern based on the desired range of motion.

20 Claims, 8 Drawing Sheets

(56) References Cited

U.S. PATENT DOCUMENTS

| | | | | |
|---|---|---|---|---|
| 9,623,285 | B1 | 4/2017 | Ruiz | |
| 10,272,294 | B2 | 4/2019 | Williams et al. | |
| 10,702,755 | B2 | 7/2020 | Sams et al. | |
| 10,878,952 | B1 | 12/2020 | Patel et al. | |
| 2003/0032525 | A1* | 2/2003 | Pyles | A63B 21/0632 482/8 |
| 2003/0032529 | A1 | 2/2003 | Alessandri et al. | |
| 2008/0161161 | A1 | 7/2008 | Pipinich et al. | |
| 2008/0207347 | A1 | 8/2008 | Rose | |
| 2010/0304934 | A1 | 12/2010 | Woodson | |
| 2015/0126332 | A1 | 5/2015 | Lannon et al. | |
| 2016/0144232 | A1 | 5/2016 | Gardner | |
| 2016/0193515 | A1 | 7/2016 | Kline | |
| 2016/0271452 | A1 | 9/2016 | Lagree | |
| 2017/0080320 | A1 | 3/2017 | Smith | |
| 2017/0087437 | A1 | 3/2017 | Vonada et al. | |
| 2018/0064992 | A1 | 3/2018 | Rothman et al. | |
| 2018/0093134 | A1 | 4/2018 | Kawabata et al. | |
| 2018/0272187 | A1 | 9/2018 | Sands et al. | |
| 2018/0318643 | A1 | 11/2018 | Klee et al. | |
| 2018/0339122 | A1 | 11/2018 | Lunz et al. | |
| 2019/0038935 | A1 | 2/2019 | Ignatyev | |
| 2019/0118065 | A1 | 4/2019 | Kertes | |
| 2019/0247707 | A1 | 8/2019 | Lagree et al. | |
| 2019/0255386 | A1 | 8/2019 | Trotter et al. | |
| 2019/0344123 | A1 | 11/2019 | Rubin et al. | |
| 2020/0171353 | A1 | 6/2020 | Fima | |
| 2020/0179755 | A1 | 6/2020 | Ristas | |
| 2020/0245900 | A1 | 8/2020 | Douglas et al. | |
| 2021/0001172 | A1 | 1/2021 | Namboodiri | |
| 2021/0008413 | A1 | 1/2021 | Asikainen et al. | |
| 2021/0016150 | A1 | 1/2021 | Jeong et al. | |
| 2021/0046373 | A1 | 2/2021 | Smith | |
| 2021/0077884 | A1 | 3/2021 | Las et al. | |
| 2022/0331683 | A1 | 10/2022 | Sorin et al. | |
| 2023/0201664 | A1 | 6/2023 | Yoo | |

OTHER PUBLICATIONS

International Search Report and Written Opinion on International Patent Application No. PCT/US2021/047764 DTD Dec. 16, 2021.
Techcrunch, "Tempo reveals $17M-funded $2000 weight lift training screen", Feb. 26, 2020, 27 pages.
Extended European Search Report on EP Patent Application No. 21864930.9 DTD Sep. 19, 2024, 13 pgs.

* cited by examiner

PACING LIGHTING SYSTEM FOR STRENGTH TRAINING APPARATUS

CROSS-REFERENCE TO RELATED APPLICATION

This application is a continuation of U.S. application Ser. No. 17/010,573, filed Sep. 2, 2020, the entire disclosure of which is incorporated by reference herein.

BACKGROUND

This application relates to exercise and rehabilitation equipment, for example resistance-based strength training equipment. The effectiveness of strength training exercises can be improved by following planned pacing or cadence, i.e., amounts of time (durations) for each phase of an exercise. However, people often have difficulty following the desired pacing for an exercise, for example due to the increased physical challenge, inaccurate perceptions of time, and various distractions that make mentally tracking time through various phases of an exercise difficult. Accordingly, systems and methods for helping a person follow a desired pacing for an exercise would be advantageous.

SUMMARY

One implementation of the present disclosure is a method of guiding pacing of a strength training exercise. The method includes receiving a selection of a current exercise from a plurality of available exercises, determining an illumination pattern based on a desired pacing for the current exercise, and controlling a lighting system to display a plurality of repetitions of the illumination pattern.

Another implementation of the present disclosure is a strength training apparatus comprising a rack configured to hold a bar between exercises performed using the bar, a lighting device coupled to the rack, and a controller communicable with the lighting device. The controller is configured to determine a desired pacing for a current exercise, and control the lighting system to display a plurality of repetitions of an illumination pattern based on the desired pacing.

Another implementation of the present disclosure is a lighting system for guiding a user through an exercise. The lighting system includes a plurality of light sources arranged in a first column and a controller configured to cause the plurality of light sources to illuminate according to an illumination pattern, wherein the illumination pattern is based on a selected exercise of a plurality of available exercises.

DETAILED DESCRIPTION

Before turning to the figures, which illustrate certain exemplary embodiments in detail, it should be understood that the present disclosure is not limited to the details or methodology set forth in the description or illustrated in the figures. It should also be understood that the terminology used herein is for the purpose of description only and should not be regarded as limiting.

Figure 1:
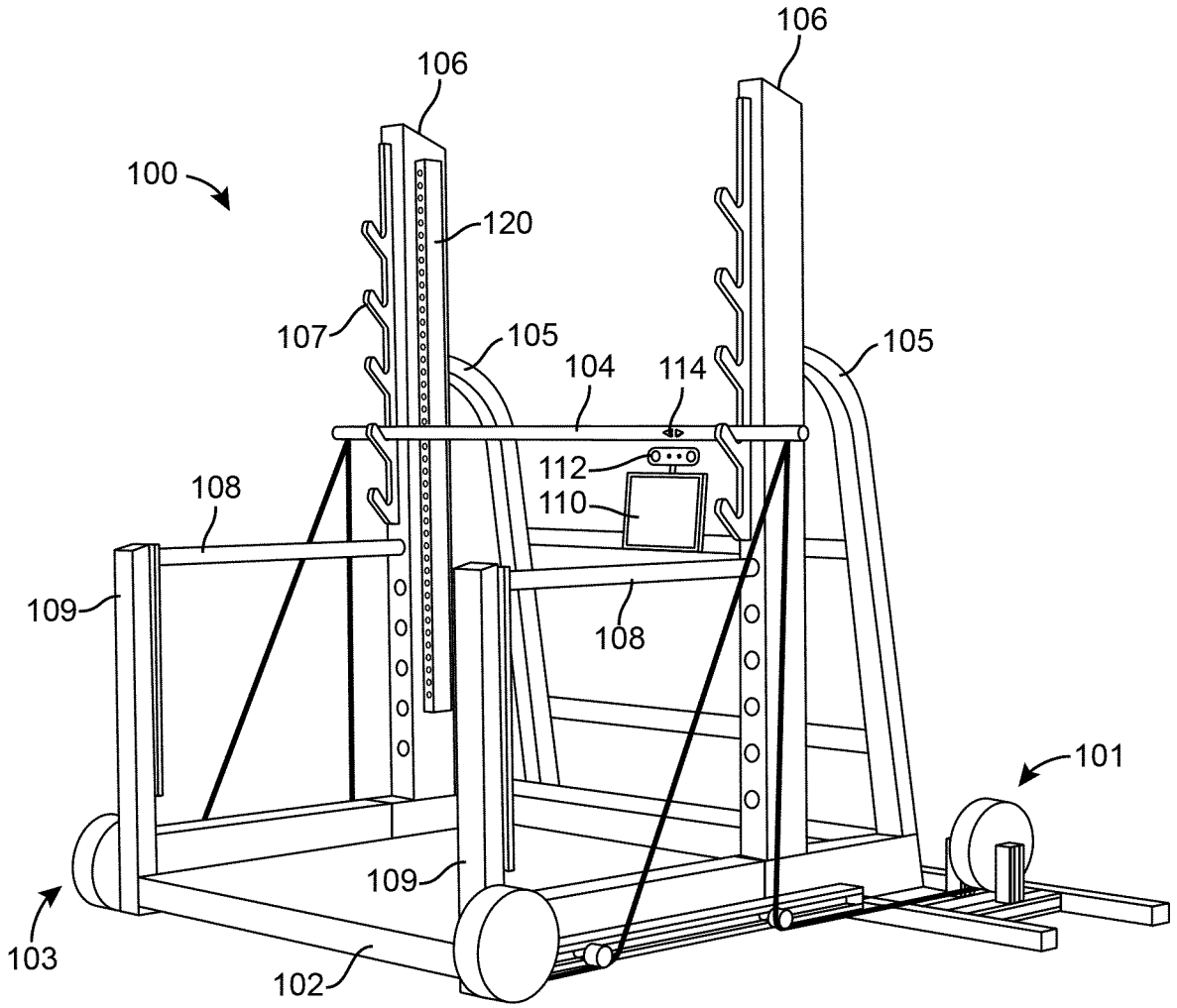
FIG. 1 is an illustration of a multi-cable strength training apparatus having a lighting device, according to an exemplary embodiment.

Referring now to FIG. 1, a perspective view of a multi-cable strength training apparatus 100 is shown, according to an exemplary embodiment. The multi-cable strength training apparatus can be configured as described in detail in U.S. patent application Ser. No. 16/909,003, filed Jun. 23, 2020, the entire disclosure of which is incorporated by reference herein. Consistent with the embodiments described therein, FIG. 1 shows a multi-cable strength training apparatus 100 includes a first dual-cable apparatus 101 and a second dual-cable apparatus 103 arranged parallel to one another and separated by a platform 102. In the configuration shown, the end effectors 116 of the dual-cable apparatuses 101, 103 are joined by a bar 104 shown in a position above the platform 102. The multi-cable strength training apparatus 100 is also shown as including a rack 105. In other embodiments, the rack 105 and/or the platform 102 is omitted.

The first dual-cable apparatus 101 and the second dual-cable apparatus 103 are configured to provide a dynamically-variable force at the bar 104 by independently controlling the tension in four cables coupled to the bar 104. For example, the first dual-cable apparatus 101 includes a first actuator assembly 150 coupled to a first cable 152. The first actuator assembly 150 includes an electric motor configured to apply a torque to rotate a drum (spool, etc.) around which the first cable 152 is wound or unwound by rotation of the drum. The first actuator assembly 150 is controllable to adjust the torque applied by the motor, thereby altering the tension in the first cable 152. A second actuator assembly 154 is coupled to a second cable 156 and similarly configured to independently adjust the tension in the second cable 156 by adjusting the torque applied to a drum by an electric motor. The first cable 152 and the second cable 156 are joined at an end effector 158.

By adjusting the tensions in the first cable 152 and the second cable 156, the first dual-cable apparatus 101 can provide a desired force vector at the end effector 158 which is controllable in both direction and magnitude. The second dual-cable apparatus 103 is similarly configured as the first dual-cable apparatus 101, and can also provide a desired force vector at an end effector 160 of the second dual-cable apparatus 103. In the example of FIG. 1, the end effector 158 of the first dual-cable apparatus 101 and the end effector 160 of the second dual-cable apparatus 103 are joined by a bar 104. Accordingly, by adjusting the various tensions in the four cables connected to the bar 104, the actuator assemblies of the dual-cable apparatuses 101, 103 can be controlled in a coordinated manner to provide a dynamically variable force vector at the bar 104.

A controller may be included, for example as shown in FIG. 1, to control the actuator assemblies of the multi-cable strength training apparatus 100 to provide force profiles suitable for performance of various selectable exercises by a user. Various additional details relating to control of the multi-cable strength training apparatus 100, according to various embodiments, are described in U.S. patent application Ser. No. 16/909,003, filed Jun. 23, 2020, the entire disclosure of which is incorporated by reference herein.

In the example of FIG. 1, the rack 105 is provided between the first dual-cable apparatus 101 and the second dual-cable apparatus 103 and includes a pair of vertical posts 106 at a first edge of the platform 102. The vertical posts 106 are configured to receive and hold the bar 104 at one or more heights above the platform 102. The rack 105 may also include a pair of rails 108 that extend perpendicular to the vertical posts 106 and which may be height-adjustable to facilitate various exercises. The rails 108 may be formed as cantilevered rails extending from the vertical posts 106 or as rails coupled to both the vertical posts 106 and rear supports 109 positioned opposite the vertical posts 106. The rails 108 are positioned between planes defined by the apparatuses 101, 103 and below the bar 104. The rails 108 may be selectively repositionable to various heights (e.g., manually, using an actuator) or selectively removed from the rack 105 to facilitate various exercises. The rack 105 is thereby configured to hold the bar 104 in various positions before and after strength-training exercises performed using the multi-cable strength training apparatus 100. The rack 105 is configured to withstand at least the maximum force that can be applied to the bar 104 by the dual-cable apparatuses 101, 103. The rack 105 facilitates the apparatus 100 in simulating traditional weight training if desired by the user as well as providing a convenient place for the user to rest the bar between exercises.

As shown, the bar 104 is provided as a linear rod (barbell attachment) that extends between the end effectors 116. In some embodiments, various attachments are provided which can be coupled to the bar 104 to facilitate different exercises. In some embodiments, the bar 104 is selectively replaceable with various attachments, for example handles, loop straps, rings, hex bars, ropes, non-linear shafts, harnesses, belts, vests, etc. While the bar 104 is connected to both the first dual-cable apparatus 101 and the second dual-cable apparatus 103, in some embodiments the bar 104 is replaceable with a first attachment for the first dual-cable apparatus 101 and a second, separate attachment for the second dual-cable apparatus 103 to facilitate exercises using either a single dual-cable apparatus 101, 103 or using both dual-cable apparatuses 101, 103 without the user perceiving a mechanical connection therebetween.

In the embodiment shown, the multi-cable apparatus 100 includes a user interface device, shown as a display screen 110. In some embodiments, multiple display screens 110 may be included. The one or more display screens 110 are configured to provide a graphical user interface to communicate information relating to operation of the apparatus 100 to a user. A display screen 110 may also be configured as a touchscreen to receive input from the user in some embodiments. As shown, the display screen 110 is mounted on the rack 105. In other embodiments, the display screen 110 may be provided as a separate device. For example, in some embodiments, the apparatus 100 can communicate with a personal device of the user, for example a smartphone or a tablet, to provide a graphical user interface via relating to multi-cable apparatus 100 on the personal device of the user. Such communication may be direct wireless communication (e.g., Bluetooth, WiFi) between the apparatus 100 and the personal device, or indirectly via a cloud server in communication with both the personal device and the apparatus 100 via the Internet.

For example, the display screen 110 may be configured to display real-time data from the device sensors as well as critical information for a selected exercise or series of exercises. In some cases, the user can select a desired type of exercise movement, workout, or diagnostic measurement via a graphical user interface of the display screen 110. The display screen 110 can show a dashboard that provides real-time information and feedback relating to form, trajectory, velocity, force, range of motion, repetition count, targets, etc. for the user during the exercise. The display screen 110 may also be controlled to show coaching videos or alerts.

As shown in FIG. 1, buttons 114 may be included on the bar 104 or other attachment to allow a user to provide user input to the apparatus 100. The buttons 114 are positioned on the bar 104 such that a user can interact with the buttons while performing an exercise (e.g., to initiate an exercise, to apply the load to the cables, to increase or decrease a resistive force, to indicate the end of an exercise, to release the load from the cables), thereby providing intra-exercise load adjustments, improving safety for the user, and improving the user's impression of control over and trust of the apparatus 100. Buttons may also be provided elsewhere on the apparatus 100.

In some embodiments, buttons are provided with the display screen 110 for interaction with the display screen and the apparatus 100 between exercises. The buttons may be wirelessly communicable with a controller. Other input devices may be used in various embodiments. For example, a microphone may be used with speech-recognition processing to allow for voice control of the apparatus 100. In some embodiments, an external device such as a smartphone or tablet is communicable with the apparatus 100 and allows a user to input commands to the apparatus.

As shown in FIG. 1, the apparatus 100 is provided with a user tracking system. The user tracking system is shown as including the platform 102 and a camera system 112. The platform 102 and the camera system 112 are configured to provide information indicative of a position of the user relative to the apparatus 100, biomechanical alignment and dimensions of the user, and other data that can be used for control of the apparatus 100 and for providing feedback and/or post-workout reports to the user, a coach/trainer, and/or to a manager of a fitness facility.

The platform 102 may include a single continuous plate that the user stands on, or a split plate that includes two equally-sized plates (one for the left foot of the user and one for the right foot of the user). The plate or plates are provided with force sensors at the corners of the plate(s). The force sensors can determine the total load on the plate and the center of pressure on the plate, either overall in the single-plate embodiment or independently for each foot in the split plate embodiment. In other embodiments, the platform 102 is provided with a force sensing mat that includes load cells distributed throughout to provide force data exerted locally at a large number of positions on the platform 102. The force sensor measurements can be used by a controller to determine the stability of the user and how the user performs the exercise. For example, the data from the force sensors can be processed to detect loss of balance or compensatory motions, and may be used to trigger a release of a load for safety purposes or to provide feedback on form to a user or coach/trainer. As another example, the platform force sensor measurements can be used to track the position of a support polygon defined by positions of the user's feet can be used in control of the apparatus 100, for example to determine a direction of a force that can be applied without pulling the user off balance or that would give a sensation of a purely-vertical force to the user. In addition, the sensor data from the platform 102 can be used to measure performance in tasks such as jumping or other exercises.

The camera system 112 can be provided in addition to or in place of the force sensors in the platform 102. The camera system 112 is configured to capture or measure the user's motions and movements. The camera system 112 may be configured to determine the pose which consists of the user's joint angles for specific joints, such as the knee and hip, or the body shape, such as the curvature of the back. The camera system 112 can determine various other anthropometric measurements, for example height, length of various body parts, etc. The camera system 112 may include a single RGB camera, several RGB cameras, or one or more infrared cameras. In embodiments with multiple cameras, the cameras may be provided in a stereoscopic arrangement and/or provided at various positions around the apparatus 100 to provide views of the user from multiple perspectives (e.g., a side view and a head-on view). In some embodiments, the camera system 112 is configured as an active system that emits its own light waves (e.g., infrared) and receives and interprets their reflections to generate tracking data (e.g., structured light systems, time-of-flight systems, LIDAR, etc.). In some embodiments, the camera system 112 is also configured to collect information regarding the position and geometry of the bar 104, end effectors 116, or cables of the apparatuses 100. Such information can be used in control of the apparatus 100. Data from the camera system 112 can be used to control the force vector applied by the apparatus 100 to improve strength training efficiency and safety, to provide real-time form correction feedback to a user (e.g., via display screen 110), and to produce post-exercise reports, videos, coaching tips, exercise programs, etc. to be provided to the user or coach. In some embodiments, the camera system 112 is used to collect user input for no-touch gesture control of a graphical user interface.

In some embodiments, the location of the bar 104 can be determined based on configuration of the dual-cable apparatuses 101, 103 and used as an indication of a user's position and movement. For example, in some embodiments, an absolute rotation sensor (rotational position sensor) is included with the spool of each actuator assembly. The rotation sensor can be integrated into the spool (drum), and rotational positions of the spool and the diameter of the spool can be used to determine the amount of cable unwound from the spool. In other embodiments, the rotation sensor is provided on a gear, which interfaces with a gear fixed on the spool. The two gears mesh, such that as the spool rotates both gears also rotate. The numbers of teeth on the gears, the diameter of the spool, and the data from the position sensor can be used to determine the amount of cable unwound from the spool. The rotation sensor and/or the gear ratio may be configured to account for multiple turns of the spool. In some embodiments, multi-turn encoders, such as a potentiometers, can be included to facilitate determination of the lengths cable fed out from the spools through multiple revolutions of the spools. A calibration routine may be executed by running the motors to fully wind and/or unwind the cables to help calibrate the rotation sensors.

In other embodiments, other tracking systems can be used to determine the position of the end effectors 116 and the real-time geometry of the apparatus 100. For example, in some embodiments an optical tracking system (e.g., stereoscopic IR camera) can be used to track a position of a fiducial marker positioned on the bar 104 in real time. As another example, image-recognition and video processing may be used to track the geometry of the cables.

In some embodiments, the apparatus 100 includes other sensors to measure biometric data such as heart rate, heart rate variability, blood saturation (e.g., oxygen saturation level), respiration rate, etc. The apparatus 100 may also communicate with a fitness tracker device of a user (e.g., watch, wrist strap, chest strap) to wirelessly (e.g., via WiFi, Bluetooth, ANT+) obtain such data. Fitness tracker data may also include information such as sleep and fatigue measurements that can be used to customize a fitness program (e.g., to reduce loads on a user when fatigued or stressed, to increase loads when one or more indicators suggest that an exercise is not challenging a user, etc.).

FIG. 1 also shows a pacing lighting system 120 coupled to a vertical post 106 of the rack 105. The pacing lighting system 120 is configured to provide intuitive, unobtrusive visual guidance of desired pacings (cadence, timing, phase durations) for strength training exercises. The pacing lighting system 120 may also be configured to provide visual guidance of a desired range of motion for a selected exercise. The pacing lighting system 120 is described in detail below with reference to FIGS. 2-8.

FIG. 1 illustrates an embodiment where the pacing lighting system 120 is integrated into and provided with a multi-cable strength training apparatus 100. In particular, FIG. 1 shows that the pacing lighting system 120 is provided on a vertical post 106 of the rack 105, such that the pacing lighting system 120 extends vertically along the vertical post 106. The vertical posts 106 are spaced apart from one another and positioned proximate lateral edges of the apparatus 100. When using the multi-cable strength training apparatus 100, a user will typically be positioned along a center line of the apparatus 100 (approximately equidistant between the vertical posts 106) and slightly offset from the vertical posts 106. Accordingly, the pacing lighting system 120 is positioned to be in a user's peripheral vision when the user is using the apparatus 100 from a typical position and facing in a forward direction. This allows the user to see the pacing lighting system 120 while keeping their visual focus on a different feature visible between the vertical posts 106, for example on a reflection of the user in a mirror which may be positioned in front of the apparatus 100. The pacing lighting system 120 is thereby placed to provide guidance to the user without obstructing a user from fixing their gaze on a feature typical to the user's conventional gym experience.

Figure 2:
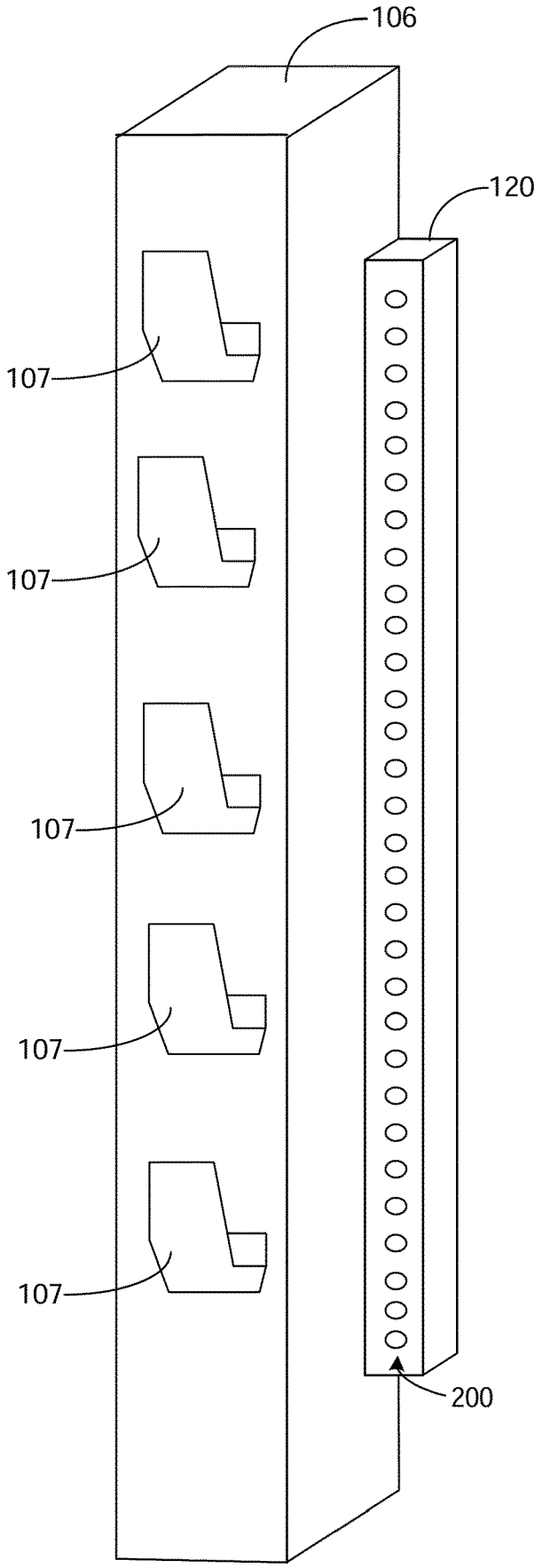
FIG. 2 is a view of the lighting device of FIG. 1 coupled to a rack of the multi-cable strength training apparatus, according to an exemplary embodiment.

Referring now to FIG. 2, a perspective view of the lighting device 120 coupled to a vertical post 106 of the rack 105 is shown, according to an exemplary embodiment. As shown, the vertical post 106 is substantially linear and extends in a vertical direction. Multiple hooks 107 are positioned at various heights along the vertical post 106. Each hook 107 is configured to selectively receive and support the bar 104 such that the bar 104 can be held at a corresponding height along the vertical post 106. The hooks 107 may be spaced substantially equidistantly along the vertical post 106 to facilitate exercises with the bar 104 beginning and ending and different heights along the vertical post (e.g., for different types of exercises, users of different heights, etc.).

The lighting device 120 is coupled to the vertical post 106 and extends along a longitudinal direction of the vertical post 106 (i.e., parallel to the vertical post 106). In the example shown in FIGS. 1-2, the lighting device 120 is positioned on a medial surface of the vertical post 106 (i.e., a side closest to a center of the rack 105, facing the other vertical post 106 of the rack 105, etc.). The lighting device 120 is thereby positioned to be visible to a user standing in a standard position for use of the rack 105 (i.e., standing substantially between the vertical posts 106 on the platform 102).

The lighting device 120 includes an array of light sources 200. In the embodiment of FIG. 2, the lighting device 120 includes a single column of light sources 200. Such an embodiment can be characterized as a one-dimensional display, i.e., a line of lights extending along a single axis or dimension. In some embodiments, the light sources 200 can be controlled in this one-dimensional display to vary in brightness or color to provide additional information along the single axis. In other embodiments, the two or more columns of light sources 200 are included.

In the embodiment shown, the light sources 200 are light emitting diodes (LED). In other embodiments, other types of light sources are used (e.g., incandescent bulbs, florescent lighting, LED display, etc.). As shown in FIG. 2, the lighting device 120 includes thirty discrete light sources arranged in a column. In other embodiments, other numbers of lights sources are included (e.g., approximately 10, 15, 25, 35, 40, etc.). The light sources 200 are individually controllable to selectively illuminate in a pattern as described in detail below. In various embodiments, each light source 200 can emit light of one, two, three, or more colors.

As shown the light sources 200 are directed outward from the lighting device 120 such that the light sources 200 are in the field of view of a user of the apparatus 100. The light sources 200 may also be positioned and oriented such that light emitted from the light sources 200 can illuminate a portion of the vertical post 106 or other surface which is in the field of view of the user.

In the embodiment shown, the light sources 200 are spaced apart from one another to extend along a vertical dimension. The vertical dimension may correspond to a typical direction of movement of a user during performance of an exercise, for example a squat, lunge, deadlift, press, etc. In some embodiments, the dimensions of the lighting device 120 are selected such that lighting device 120 is at least as long as a full range of motion of an exercise to be performed at the apparatus 100. Correspondence between the lighting device 120 and positions along the range of motion may therefore be intuitive to a user. For example, as shown, in FIG. 2, the lighting device has a top end aligned with a highest hook 107 and a bottom end that extends below the lowest hook 107 (e.g., to an expected bottom of a squat exercise for a typical user).

In other embodiments, other dimensions and positioning for the lighting device 200 may be used. For example, the lighting device 200 may be positioned at a height on the vertical post 106 that aligns with eye-level for typical users to facilitate visibility of the lighting device 200 by the users. The lighting device 200 may have a length in a range between two feet and four feet, for example approximately three feet. Although, FIG. 2 shows an embodiment with discrete light sources (e.g., visible distinct to a typically user's eye), in other embodiments the lighting device includes a substantially-continuous light source (e.g., display screen, large number of adjacent light sources, etc.). The embodiments shown include light sources 200 which can communicate information based on on/off status, color, and/or brightness. In other embodiments, an array of lights or display screen is configured to display symbols which can move along the lighting device according to the various methods described below.

Figure 3:
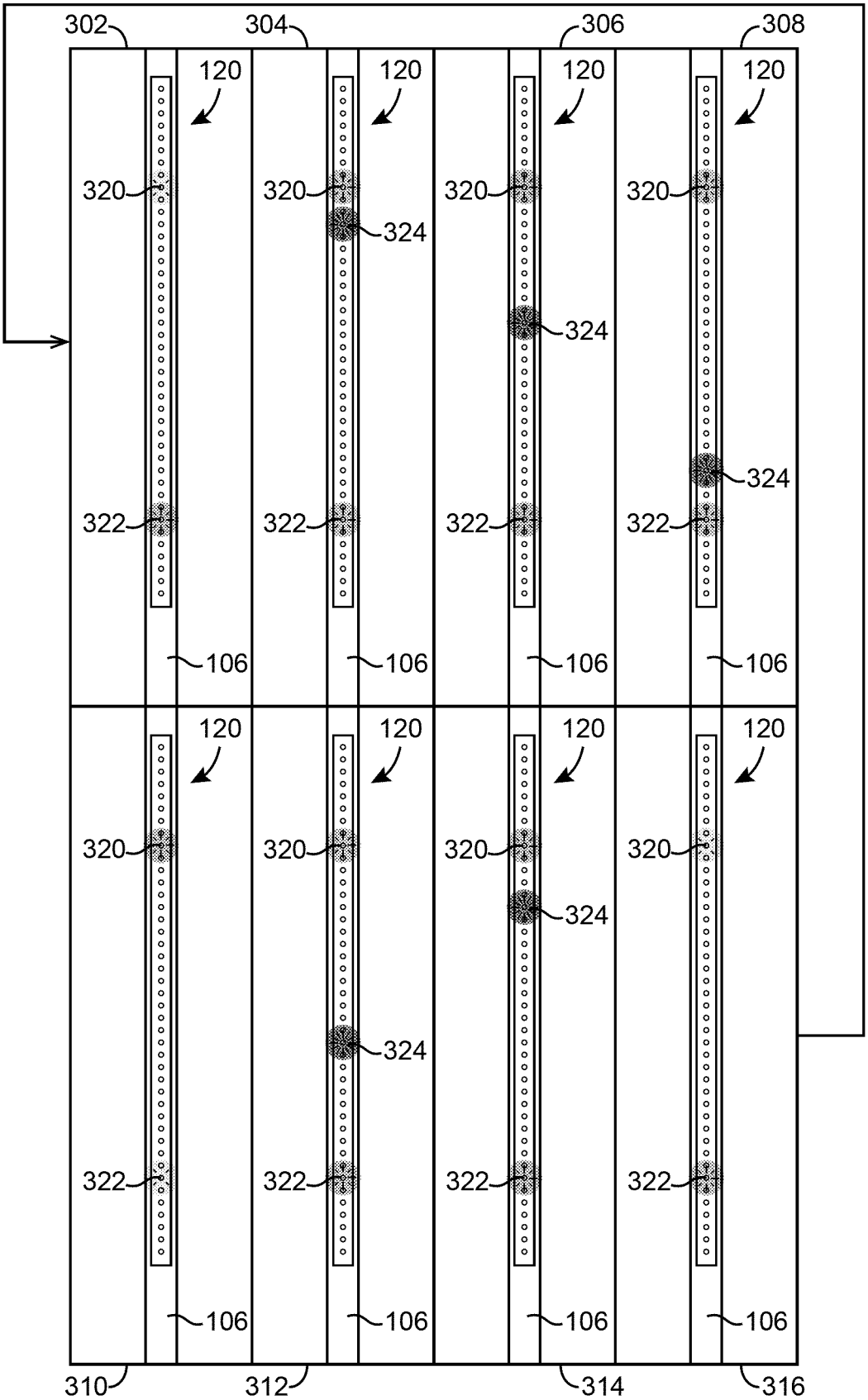
FIG. 3 is a storyboard-style illustration of operation of the lighting device, according to an exemplary embodiment.

Referring now to FIG. 3, a storyboard-style illustration showing operation of the lighting device 120 to provide pacing guidance for performance of an exercise is shown, according to an exemplary embodiment. A sequence of views of the lighting device 120 are illustrated to show how the light sources 200 can be controlled to sequentially illuminate (e.g., in a variety of colors as shown) to provide an illumination pattern based on a desired pacing for a selected exercise. Multiple repetitions of the illumination pattern, corresponding to multiple repetitions of an exercise, can be provided by cycling through a first frame 302, second frame 304, third frame 306, fourth frame 308, fifth frame 310, sixth frame 312, seventh frame 314, and eighth frame 316 for a desired number of repetitions.

As shown in the first frame 302, a first portion of the lighting device 120 (i.e., a first subset of the light sources 200) illuminates to illuminate a first end point 320 of a range of motion in a first color (e.g., green) and a second end point 322 in a second color (e.g., white). In the example of FIG. 3, a remainder of the lighting device 120 illuminates to provide light of a third color (e.g., blue) along the remainder of the lighting device 120 (i.e., at light sources 200 not corresponding to the first end point 320 or the second end point 322.

As shown, the first end point 320 is positioned proximate a top end of the lighting device 120 and the second end point 322 is positioned proximate a bottom of the lighting device 120. A spacing between the first end point 320 and the second end point 322 indicates a full range of motion for a selected exercise. The first end point 320 and the second end point 322 may be adjusted in position along the lighting device 120 for different exercises (e.g., brought closer together for an exercise with a smaller desired range of motion), for users of different heights (e.g., lowered on the lighting device 120 for shorter users), or to otherwise facilitate intuitive communication of a desired range of motion for performance of an exercise by a user.

In the first frame 302, the first end point 320 is indicated by a first color (e.g., green), and the second end point 322 is indicated by a second color (e.g., white). The first color indicates that the current desired position for the exercise is at the top of the range of motion for the exercise. This may be the starting point for many exercises, for example squats or lunges. Accordingly, in the example shown, the exercise can be initiated with the lighting device 120 illuminated as shown in the first frame 302.

From the first frame 302, when the illumination pattern for the lighting device 120 is initiated, the light sources 200 are controlled to transition to the configuration shown in the second frame 304. The illumination pattern can be initiated in response to a user input, for example by voice command (in an embodiment where a microphone is included in the apparatus 100) or by a user engaging a button 114 on the bar 104. In some embodiments, the illumination pattern is initiated based on tracking of movement of the bar 104 or the user, for example to automatically initiate the illumination pattern in response to detecting user movement.

As shown in the second frame 304, the first end point 320 has been update to the second color (e.g., white), such that the first end point 320 and the second end point 322 are the same color. In other embodiments, the first end point 320 and the second end point 322 are differentiated in a different manner. For example, the first end point 320 and the second end point 322 may be indicated by a lack of illumination at either end of a range of motion which itself is illuminated along the lighting device 120. The first end point 320 and the second end point 322 are configured to indicate extremums of a desired range of motion for the exercise being performed by the user.

The second frame 304 also shows a pacing point 324 illuminated in a fourth color (e.g., red) proximate the first end point 320 and between the first end point 320 and the second end point 322. That is, a portion (subset) of the lighting devices 200 are controlled to illuminate to provide a visualization of the pacing point. As further indicated by the sequence of the second frame 304, the third frame 306, and the fourth frame 308, the light sources 200 are controlled to sequentially illuminate such that the pacing point 324 moves along the lighting device 120 from the first end point 320 to the second end point 322. As described in detail below, the lighting device 120 is controlled such that the pacing point 324 moves along the lighting device 120 from the first end point 320 to the second end point 322 in a predetermined amount of time corresponding to a desired duration of a downward (e.g., concentric) phase of a selected exercise.

The second frame 304, third frame 306, and fourth frame 308 show discontinuous points in time to illustrate that the lighting device 120 can be configured to provide substantially continuous, smooth movement of the pacing point 324 along the lighting device 120, for example with a constant velocity between the first end point 320 and a second end point 322. In some cases, an irregular pacing (e.g., varying velocity of movement) may be desired for a selected exercise, such that the pacing point 324 can be caused to move according to the irregular pacing. Adjacent light sources 200 are controlled to illuminate sequentially, such that movement of pacing point 324 can be followed, mimicked, etc. in real space by a user's movement and/or movement of the bar 104.

In the fifth frame 310, the pacing point 324 has reached the second end 322, and the second end 322 is updated to illuminate in the first color (e.g., green) to indicate that the pacing point 324 is at the second end 322. That is, the subset of the light sources 200 corresponding to the second end 322 are controlled to change colors to indicate that the pacing point 324 is at the second end 322. The pacing point 324 no longer appears elsewhere on the lighting device 120, creating the illusion of overlap between the second end 322 and the pacing point 324. The lighting device 120 can be controlled to pause in the state shown in the fifth frame 310 (i.e., with the pacing point 324 at the bottom of a range of motion) for a predetermined amount of time associated with a desired duration of a static hold at a bottom of a range of motion for the exercise being performed by the user.

In the sixth frame 312 and the seventh frame 314, the pacing point 324 moves upwards from the second end point 322 toward the first end point 320. The light sources 200 at the first end point are controlled to return to the second color 322 to match the first end point 320. As described in detail below, the lighting device 120 is controlled such that the pacing point 324 moves along the lighting device 120 from the second end point 322 to the first end point 320 in a predetermined amount of time corresponding to a desired duration of an upward (e.g., eccentric) phase of a selected exercise.

In the eighth frame 316, the pacing point 324 has reached the first end point 320 and the light sources 200 at the first end point 320 are controlled to illuminate in the first color (e.g., green). The first end point 320 is thereby updated to indicate that the pacing point 324 is at the first end point 320, i.e., that a desired position for a user performing the selected exercise is at a top of a range of motion. The lighting device 120 can be controlled to maintain the state shown in the eighth frame 316 for a predetermined amount of time, thereby guiding a user to pause at the top of the range of motion (e.g., perform a static hold at the top of the range of motion) for that amount of time.

The eighth frame 316 matches the first frame 302, and the operation of the lighting device 120 can be looped back to the first frame 302 following the eighth frame 316. The lighting device 120 can be controlled to proceed automatically from the state shown in the eighth frame 316 and the first frame 302 to the downward movement of the pacing point 324 of the third frame 306 following the predetermined amount of time for the exercise to pause at the top of the range of motion. A repeating illumination pattern can thereby be provided at the lighting device 120.

The repeating illumination pattern can be repeated multiple times, such that the lighting device 120 is repeatedly controlled to sequentially illuminate subsets of the light sources 200 to create a pacing point which pauses at a first end point 320 of a range of motion for a first amount of time, moves in a continuous manner from the first end point 320 of the range of motion to a second end point 322 of the range of motion in a second amount of time, pauses at the second end point 322 for a third amount of time, and moves from the second end point 322 to the first end point 320 in a fourth amount of time.

The repeating illumination pattern can repeat the illumination pattern any number of times, for example for a number of repetitions corresponding to a user's workout plan. For example, if a user plans (e.g., selects via user interface) to perform ten repetitions of a squat exercise, the lighting device 120 may be controlled to repeat the illumination pattern ten times. In some embodiments, the lighting device 120 can be controlled to automatically stop the illumination pattern when a user stops performing the exercise (e.g., in response to detecting a stop in the user's movement or movement of the bar 104, in response to the bar 104 engage a hook 107 of the rack 105, etc.).

FIG. 3 shows illumination of a lighting device 120 according to an exemplary embodiment. Various other illumination patterns and configurations of the lighting device 120 are possible. For example, in some embodiments, a single color of light is used and only a subset of light sources corresponding to the pacing point 324 are illuminated at any given time. The end points may be fixed, for example indicated by icons or labels painted or printed on the lighting device 120 or rack 105. In some embodiments, blinking, flashing, strobing, etc. of the light sources 200 is used to communicate information about pacing or a range of motion.

In the embodiment of FIGS. 2-3, the lighting device includes a single column of light sources 200 forming a one-dimensional display, such that the illumination pattern is provided along a one-dimensional display. In other embodiments, one or more additional lights sources 200 are provided, for example such that the end points 320, 322 can be indicated alongside an axis along which the pacing point 324 moves (thereby eliminating overlap between the pacing point 324 and the end points 320, 322). In various embodiments, various colors may be used. In some embodiments, the colors or other aspects of the illumination pattern (e.g., size of the illuminated points, whether the entire range of motion stays illuminated, whether the end points are constantly illuminated, etc.) may be user-customizable via a user interface device.

Figure 4:
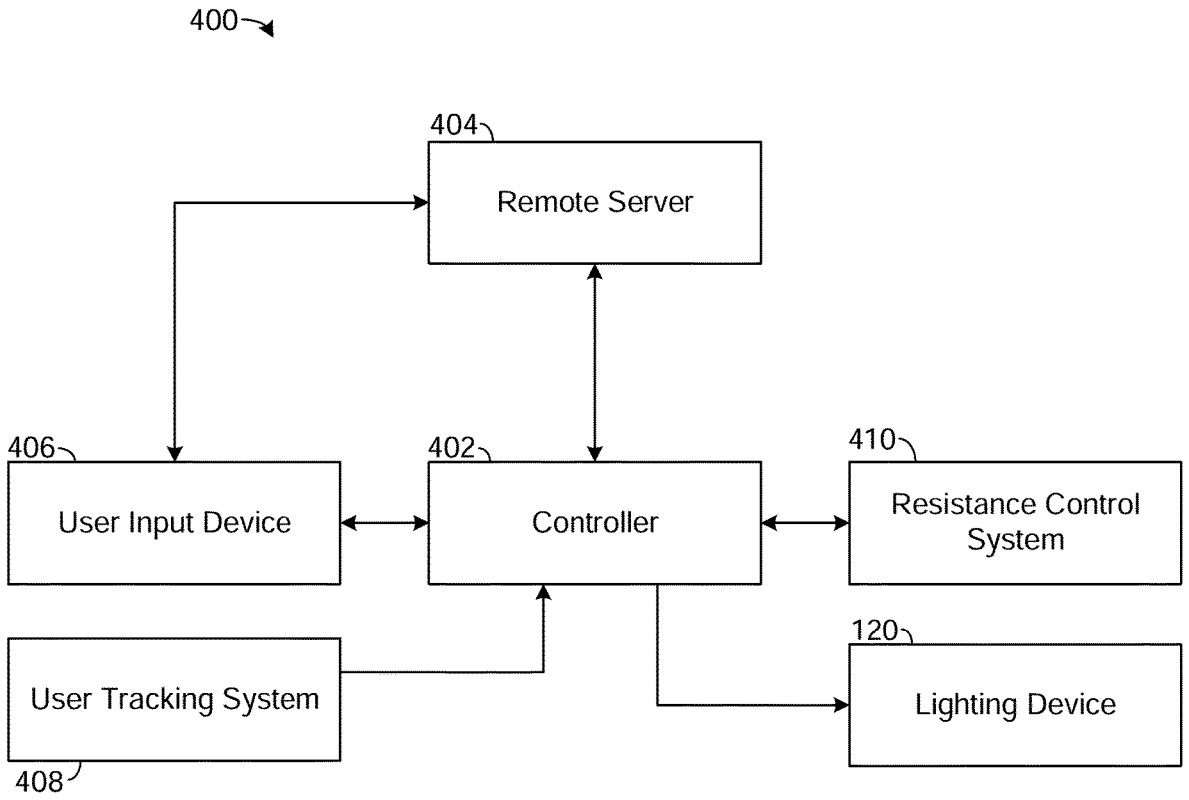
FIG. 4 is block diagram of a control system for the lighting device, according to an exemplary embodiment.

Referring now to FIG. 4, a block diagram of a control system 400 for controlling the lighting device 120 is shown, according to an exemplary embodiment. The control system 400 is shown to include a controller 402, a remote server 404, a user input device 406, a user tracking system 408, and the lighting device 120. The control system 400 is configured provide for the display of various illumination patterns by the lighting device 120.

The controller 402 is configured to control the light sources 200 of the lighting device 120 to control the light sources 200 to selectively and sequentially illuminate according to an illumination pattern associated with a selected exercise. The controller 402 may include one or more processors and non-transitory computer readable media storing program instructions executable by the one or more processors to perform the various operations described herein. For example, the hardware and data processing components used to implement the controller 402, other computing components and methods described herein may include a general purpose single- or multi-chip processor, a digital signal processor (DSP), an application specific integrated circuit (ASIC), a field programmable gate array (FPGA), or other programmable logic device, discrete gate or transistor logic, discrete hardware components, or any combination thereof designed to perform the functions described herein. A general purpose processor may be a microprocessor, conventional processor, or state machine. A processor also may be implemented as a combination of computing devices, such as a combination of a DSP and a microprocessor, a plurality of microprocessors, one or more microprocessors in conjunction with a DSP core, or any other such configuration. In some embodiments, particular processes and methods may be performed by circuitry that is specific to a given function. Controllers herein may include computer-readable media (e.g., memory, memory unit, storage device), which may include one or more devices (e.g., RAM, ROM, Flash memory, hard disk storage, EPROM, EEPROM, other optical disk storage, magnetic disk storage or other magnetic storage devices, any other medium which can be used to carry or store desired program code in the form of machine-executable instructions or data structures, combinations thereof) for storing data and/or computer code for completing or facilitating the various processes, layers and modules described in the present disclosure. The memory may be or include volatile memory or non-volatile memory, and may include database components, object code components, script components, or any other type of information structure for supporting the various activities and information structures described in the present disclosure. According to an exemplary embodiment, the memory is communicably connected to the processor via a processing circuit and includes computer code for executing (e.g., by the processing circuit or the processor) the one or more processes described herein. The controller 402 includes an internal clock and/or standard capabilities for measuring passage of time in a computer system. Although FIG. 4 shows the controller 402 as a discrete computing system, in some embodiments features attributed herein to the controller 402 are performed at the remote server 404 and/or onboard the user input device 406 (e.g., a smartphone or tablet of a user).

The controller 402 may be configured to perform the steps shown in FIGS. 5-8 and described in detail below with reference thereto in order to control the lighting device 120. For example, in some embodiments, controller 402 stores multiple illumination patterns and an association between each illumination pattern and a user-selectable exercise. The controller 402 may be communicable with the user input device 406 to receive a user selection of a current exercise to be performed by the user, and access the associated illumination pattern. The controller 402 can then control the lighting device 120 based on the selected exercise to cause the light sources 200 to selectively illuminate to provide the associated illumination pattern.

As one example, each illumination pattern may be defined by a set of four values that set amounts of each time for each phase of an exercise. In a particular, a downward movement duration $T_{down}$, a lower endpoint pause duration $T_{bottom}$, an upward movement duration $T_{up}$, and an upper endpoint pause duration $T_{top}$. In such embodiments, each exercise stored by the controller 402 is associated with a desired pacing defined by a data object storing a value for each of $T_{down}$, $T_{bottom}$, $T_{up}$, and $T_{top}$. For example, a first exercise may be associated with the object $\{T_{down}=5, T_{bottom}=1, T_{up}=5, T_{top}=5\}$, showing a downward duration of five seconds (or other time unit in various embodiments), a one second pause at a bottom of a range of motion, a five second upward duration, and a one second pause at a top of the range of motion. A second exercise may be associated with different values for the desired pacing, for example $\{T_{down}=4, T_{bottom}=2, T_{up}=1, T_{top}=2\}$. When an exercise is selected, the controller 402 may execute a function to apply the relevant values for $T_{down}$, $T_{bottom}$, $T_{up}$, $T_{top}$ and then execute programming instructions which use the values of $T_{down}$, $T_{bottom}$, $T_{up}$, $T_{top}$ in generate control signals for the light sources 200 of the lighting device 120.

The values of each phase for various different exercises can be predefined in the controller 402, for example by expert fitness professionals during configuration and manufacturing of the controller 402. In some embodiments, user customization of an exercise pacing is enabled by allowing a user to manual input values for each of $T_{down}$, $T_{bottom}$, $T_{up}$, and $T_{top}$, for example via the user input device 406 of FIG. 4. In some embodiments, manual user definition of $T_{down}$, $T_{bottom}$, $T_{up}$, and $T_{top}$ is used and storage of predefined pacings is omitted, thereby reducing the computing requirements of the controller 402. In some embodiments, one or more customized exercises and pacings can be stored at the controller 402 or at the remote server 404 for later selection by the user.

In various embodiments, additional variables are used to define the desired pacings and illumination patterns, for example to enable more complex motions. For example, acceleration or velocity values for the upward or downward phases could be used to define illumination patterns. As another example, the data object can include information indicative of a range of motion for the exercise, for example such that the end point 320, 322 can be positioned appropriately for different exercises. As another example, variables or logic may be used to vary the pacing between repetitions, for example to indicate that a second repetition should be completed using slower movements than a first repetition. Various degrees of complexity are possible in various embodiments.

As shown in FIG. 4, the controller 402 may be communicable a remote server 404, for example via the internet. The remote server 404 is configured to store various information to provide additional functionality, customizability, options, programs, illumination patterns, workout plans, exercises, etc. to enable use of the lighting device 120. For example, the remote server 404 may provide additional storage space to enable storage of a large number of exercises and associated desired pacings (e.g., associated data objects $\{T_{down}, T_{bottom}, T_{up}, T_{top}\}$). The remote server 404 can be configured to enable addition of new exercises and desired pacings to the capabilities of the controller 402 and/or modification of existing exercises and desired pacings stored locally at the controller 402. The remote server 404 may also store user-specific data, for example a user profile that can facilitate user-specific customization or allow a user to track workouts over time.

The user input device 406 may be communicable with the controller 402 (e.g., via local wired or wireless communications such as Bluetooth or WiFi) and/or the remote server 404 (e.g., via the internet). The user input device 406 may be a dedicated interface provided with the apparatus 100 or the lighting device 120, for example as shown for display 110 of FIG. 1 and described with reference thereto. User input devices 406 can include a switch, touchscreen, pedal, buttons (e.g., buttons 114), dials, microphone-based speech-recognition device, gesture-control camera systems, smartphone or tablet interfaces, smart watch interfaces, and/or various other devices configured to accept user input and communicate the user input to the controller 402. The user input devices 406 can be physically integrated into the multi-cable apparatus 100 or the lighting device 120, or may be provided separately and wireless communicable with the controller 402 (e.g., via Bluetooth, WiFi, ANT+, near-field communication, consumer infrared (CIR) light-based communication, etc.).

In some embodiments, the user input device 406 is a smartphone, tablet, or other personal computing device of the user. In such embodiments, a mobile application may be provided on the personal computing device which facilitates user input to the control system 400. In various embodiments, various inputs or sensors of a personal computing device may be used to collect inputs for the control system 400, for example a touchscreen to receive direct user selections via a graphical user interface, a microphone and to receive voice-based commands, and accelerometer to detect motion of the user, which can be used to select an exercise, initiate an illumination pattern, end an illumination pattern, or collect other relevant data. In some embodiments, the computing resources provided in the personal computing device used as the user input device 406 are used to perform various functions attributed herein to the controller 402.

In the embodiment shown, the control system 400 also includes a resistance control system 410, for example configured to control actuator assemblies of the first dual-cable apparatus 101 and the second dual-cable apparatus 103 of the embodiment of FIG. 1. The controller 402 may be configured to provide control signals to the resistance control system 410 to cause the resistance control system 410 to provide resistance (e.g., force) to a user in accordance with the control signals from the controller 402. In such embodiments, control of the resistance (e.g., dynamic force vector) on a user during a strength exercise can be coordinated with control of the lighting device 120. For example, U.S. patent application Ser. No. 16/909,003, filed Jun. 23, 2020 and incorporated by reference herein, describes a control system for a strength-training apparatus which may be adapted in accordance with the disclosure herein to provide coordinated control of the lighting device 120 and a resistance/force system.

In other embodiments, the lighting device 120 is provided independent of a resistance system (as a stand-alone device) or with a traditional weight-training system (e.g., a rack, a free weight system, a conventional weight-based cable machine). In such embodiments, the resistance control system 410 is omitted. In some such embodiments, the controller 402 is provided within a housing of the lighting device 120.

In the embodiment shown in FIG. 4, the control system 400 also includes a user tracking system 408 configured to provide data indicative of a user's position or movement relative to a range of motion for the selected exercise. The user tracking system 408 can include, for example, the camera system 112 and/or the force sensors of the platform 102 described above with reference to FIG. 1. The user tracking system 408 may also include a user's fitness tracker device (e.g., watch, chest strap monitor, other electronic fitness accessory) or personal computing device (e.g., smartphone). Accordingly, the user tracking system 408 is configured to provide data indicative of a user's position relative to the multi-cable apparatus 100. The user tracking system 408 may also provide other biometric data, video files, and/or other user-related data to the controller 402. In some embodiments, the user tracking system 408 is implemented by tracking a position of the bar 104 or other element of a resistance system (e.g., using sensors internal to actuator assemblies of the multi-cable apparatus 100, using a camera system and fiducial markers coupled to end effectors of the multi-cable apparatus 100, etc.). For example, the user tracking system 408 may include a tether connected to the bar 104 and a measuring system coupled to the tether (e.g., positioned on the ground, mounted to a rack, etc.) and configured to allow the tether to be released from or retracted from the measuring system while using a linear positional transducer or other sensor for determining a length of the tether released from the measuring system and a sensor that measures an angle at which the tether departs from the measuring system (i.e., a linear positional transducer with angle measurement system).

Figure 8:
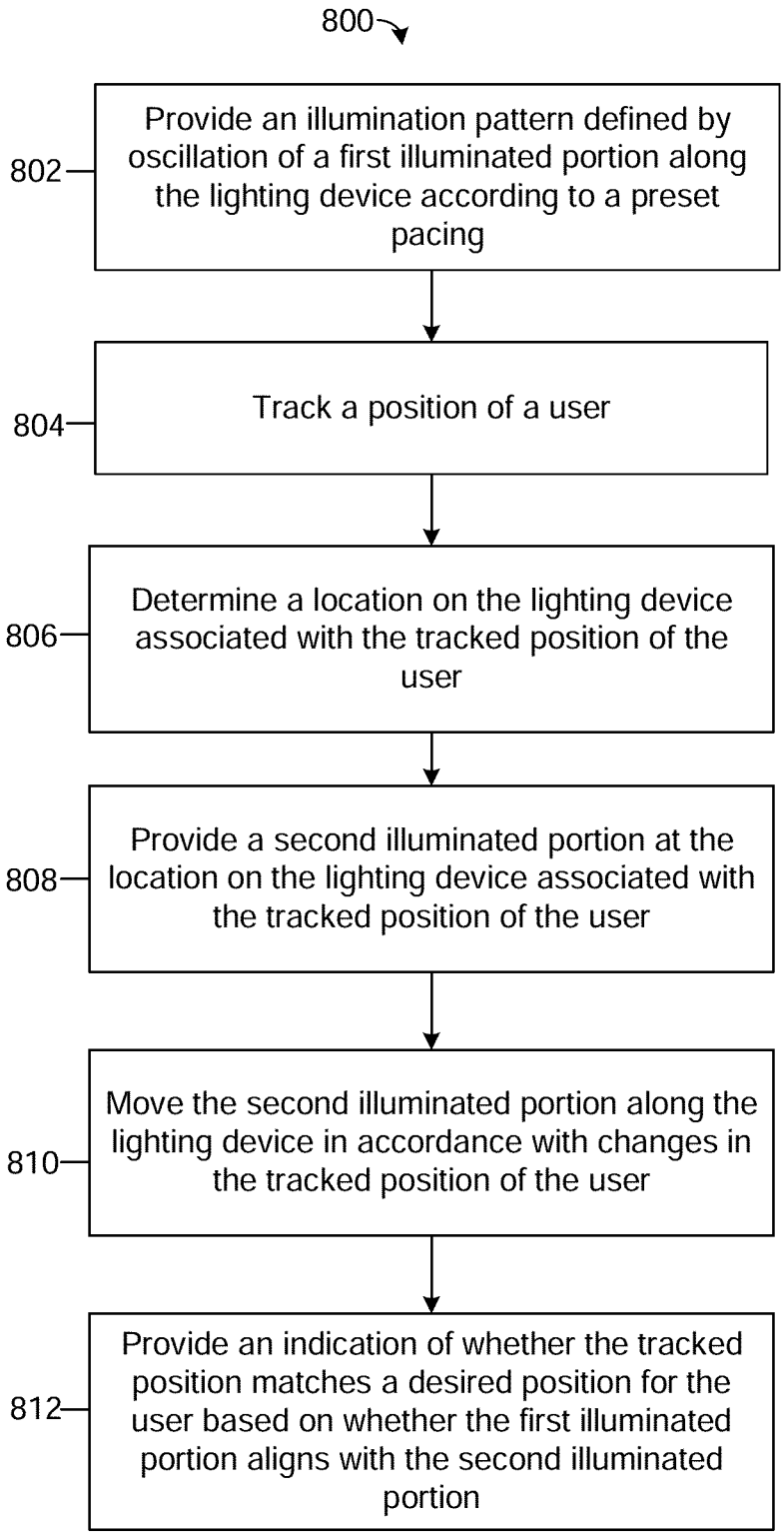
FIG. 8 is a flowchart of a process for controlling a lighting device to guide performance of an exercise including real-time user tracking, according to an exemplary embodiment.

In embodiments where the control system 400 includes the user tracking system 408, the controller 402 is configured to control the lighting device 120 to provide an indication of a tracked position of a user relative to a desired position indicated by the illuminated pacing point of the illumination pattern. In such embodiments, the controller 402 is configured to map the tracked user to position to a point along the lighting device 120 (e.g., to a particular light source 200 of the multiple light sources of the lighting device 120). For example, a range of motion for the user (in real space) may be scaled to range of motion indicated at the lighting device 120 (e.g., to a distance between the first end point 320 and the second end point 322), such that a position along the user's range of motion can be mapped to a point on the lighting device 120. The controller 402 can update the position of an illuminated point on the lighting device 120 based on changes in the tracked position of the user. FIG. 8 shows a control approach for providing user tracking information via the lighting device 120, according to an exemplary embodiment, and is described in detail below with reference thereto.

Figure 5:
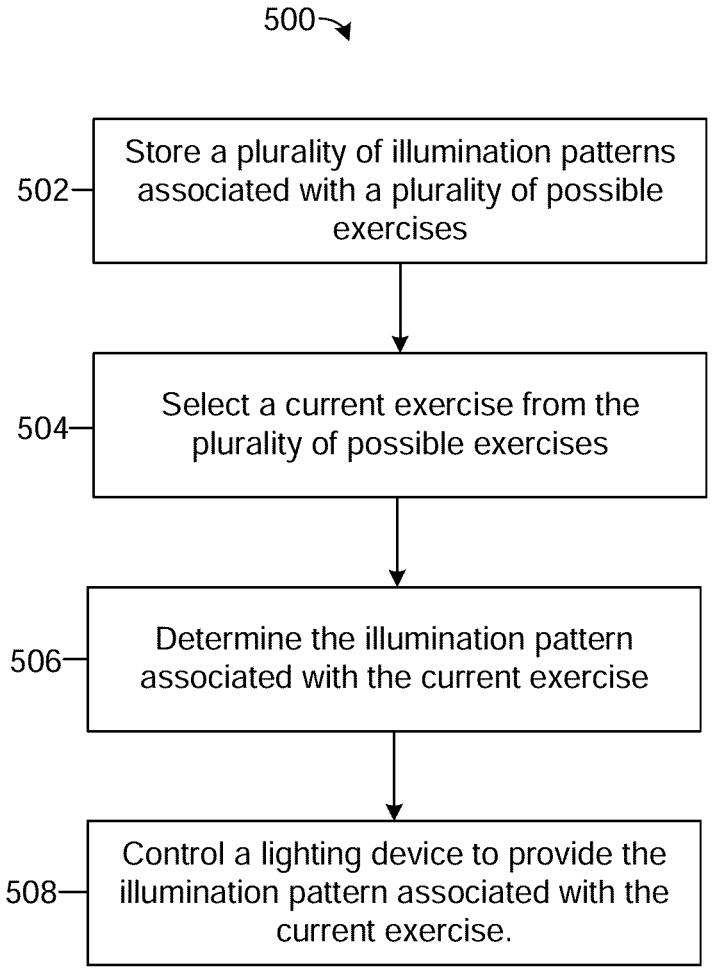
FIG. 5 is a flowchart of a first process for controlling a lighting device to guide performance of an exercise, according to an exemplary embodiment.

Referring now to FIG. 5, a flowchart of a process 500 for controlling the lighting device 120 is shown, according to an exemplary embodiment. The process 500 can be executed by the control system 400 of FIG. 4 in some embodiments.

At step 502, a plurality of illumination patterns associated with a plurality of possible exercises are stored. For example, the mapping between the plurality of illumination patterns and a list of possible exercises can be stored on the controller 402 and/or at the remote server 404. Each illumination pattern may be defined based on values for a set of variables, for example a set of durations for the phases of an exercises (e.g., $\{T_{down}, T_{bottom}, T_{up}, T_{top}\}$). These values can be stored in a database of a memory device of the controller 402 or of the remote server 404. Step 502 can be performed during initial configuration of the controller 402, for example. In some embodiments, step 502 is performed based on user input specifying a desired pacing for an illumination pattern for a custom exercise.

At step 504, a current exercise is selected from the list of multiple possible exercises, i.e., from the list of exercises for which an illumination pattern is stored. The exercise selection may be achieved based on a user input indicating a desired exercise. In some embodiments, a workout routine including a series of sequential exercises is used, such that the current exercise is selected based on the workout routine and can be automatically updated as a user completes the workout routine.

At step 506, an illumination pattern associated with the current exercise is determined. The illumination pattern can be determined by looking up the illumination pattern (e.g., set of durations for the phases thereof) stored at step 502 which is associated with the current exercise selected at step 504. The illumination pattern specific to the current exercise is thereby determined.

At step 508, a lighting device is controlled to provide the illumination pattern associated with the current exercise and determined at step 506. For example, the controller 402 can independently control the multiple light sources 200 of the lighting device 120 such that the light sources 200 illuminate to provide the illumination pattern. For example, as described in detail elsewhere herein, controlling the lighting device to provide the illumination pattern may include causing the multiple light sources 200 to sequentially illuminate such that an illuminated point moves along the lighting device 120 with a pacing defined for the exercise. Step 508 can be continued until a desired number of repetitions for the current exercise have been completed.

Figure 6:
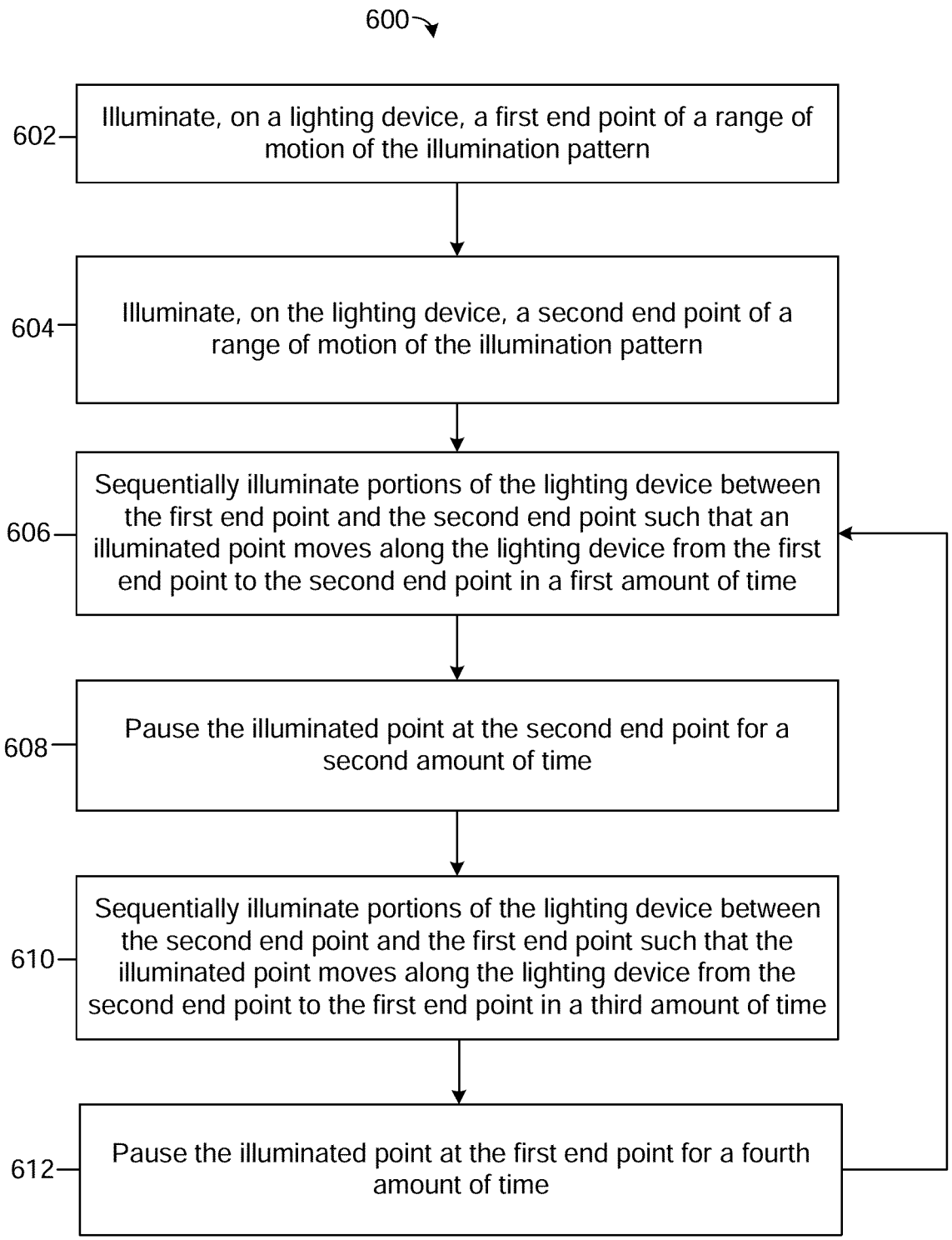
FIG. 6 is a flowchart of a second process for controlling a lighting device to guide performance of an exercise, according to an exemplary embodiment.

Referring now to FIG. 6, a flowchart of a process 600 for controlling the lighting device to provide an illumination pattern is shown, according to an exemplary embodiment. The process 600 is an example embodiment of step 508 of FIG. 5. The process 600 can be executed by the control system 400 of FIG. 4 in some embodiments.

At step 602, a first end point of a range of motion for an illumination pattern is illuminated on a lighting device. For example, a light source 200 (or a set of adjacent light sources 200) is determined to be associated with a first end point of a range of motion. The first end point may change for different exercises, based on the anthropometric measurements of a user (e.g., height, leg length, lower leg length, torso length, arm length, etc.), or based on some other factor such as which hook 107 of the rack 105 is in used to hold a bar 104 in the example of FIG. 1. The identified light source 200 is then controlled to illuminate (e.g., provided with electrical energy which causes the identified light source 200 to emit visible light). In other embodiments, the first end point is predetermined and constant across any selected exercise, such that the same light source 200 is illuminated in various iterations of step 602. Step 602 may result in providing the first end point 320 as shown in FIG. 3.

At step 604, a second end point of the range of motion for the illumination pattern is illuminated on the lighting device. For example, a light source 200 (or a set of adjacent light sources 200) is determined to be associated with a second end point of the range of motion. The second end point may change for different exercises, based on a location of the first end point, based on an anthropometric measurement of a user, or based on some other factors. The identified light source 200 is then controlled to illuminate. In other embodiments, the second end point is predetermined and constant across any selected exercise, such that the same light source 200 is illuminated in various iterations of step 604. Step 604 may result in providing the second end point 322 as shown in FIG. 3.

At step 606, portions of the lighting device are sequentially illuminated between the first end point and the second end point such that an illuminated point (pacing point) moves along the lighting device from the first end point to the second end point in a first amount of time. Light sources 200 are sequentially controlled to turn on (illuminate) and then turn off (cease illumination) to create an illusion of motion. In other embodiments, the light sources 200 remain illuminated but are varied in color to create the illusion of movement of a colored point along the lighting device 120. In alternative embodiments, a single light sources is used and physically moves (e.g., under power of an actuator) along the lighting device between the first end point and the second end point.

Step 606 is accomplished in a first amount of time, which is defined based on a desired pacing for the current exercise. For example the first amount of time may be a value stored at step 502 and accessed at step 506 of the process 500 of FIG. 5. The illuminated point may be caused to move with a constant velocity between the first end point to the second end point, where the velocity is defined by the distance of between the first and second endpoints (i.e., a measurement of the range of motion) over the first amount of time. In other embodiments, the velocity is defined as a pre-stored variable in place of the first amount of time.

At step 608, the lighting device is controlled such that the illuminated point pauses at the second end point for a second amount of time. That is, in step 608, the lighting device is illuminated in a state that shows that the illuminated point has reached and is positioned at the second end point. This may be indicated by a color change, blinking effect, or other lighting effect in various embodiments. The lighting device remains in such a state for the second amount of time.

Step 610 is initiated in response to the end of the second amount of time. At step 610, portions of the lighting device are sequentially illuminated between the second end point and the first end point such that the illuminated point moves along the lighting device from the second end point to the first end point in a third amount of time. For example, light sources 200 may be sequentially controlled to illuminate and cease illuminating to create an illusion of motion of a point along the lighting device 200. Step 610 is performed in a third amount of time, which is predetermined based on a desired pacing for the current exercise. The third amount of time and the distance between the first end point and the second end point is determinative of a velocity of the illuminated point. In other embodiments, the velocity is a pre-stored values which is determinative of the third amount of time.

At step 612, the lighting device is controlled such that the illuminated point pauses at the first end point for a fourth amount of time. That is, in step 612, the lighting device is illuminated in a state that shows that the illuminated point as reached and is positioned at the first end point. This may be indicated by a color change, blinking effect, or other lighting effect in various embodiments. The lighting device remains in such a state for the fourth amount of time.

Following the fourth amount of time and step 612, the process 600 may return to step 606 and repeatedly perform step 606, step 608, step 610, and step 612 to provide the illumination pattern at the lighting device 120. These steps may be repeated for a desired number of repetitions, for example input by a user, defined in a workout plan, or otherwise assigned. In some embodiments, the steps are repeatedly performed until the user selects a button (e.g., but 114) or provides some other command via a user interface device requesting an end to the illumination pattern. In such an event, the process 600 is ended.

Process 600 provides an example embodiment of a type of illumination pattern which can be provided via the lighting device 120 and the approach of the present application. Other illumination patterns are also possible. For example, steps 606 and 610 may include varying the direction of movement, velocity, and acceleration of the illuminated point to create any desired effect which maps to a desired movement for an exercise performed by a user. As another example, the end points may be updated between repetitions, such that the process 600 loops back to step 602 and step 604 at each repetition. Any such variations are within the scope of the present disclosure.

Figure 7:
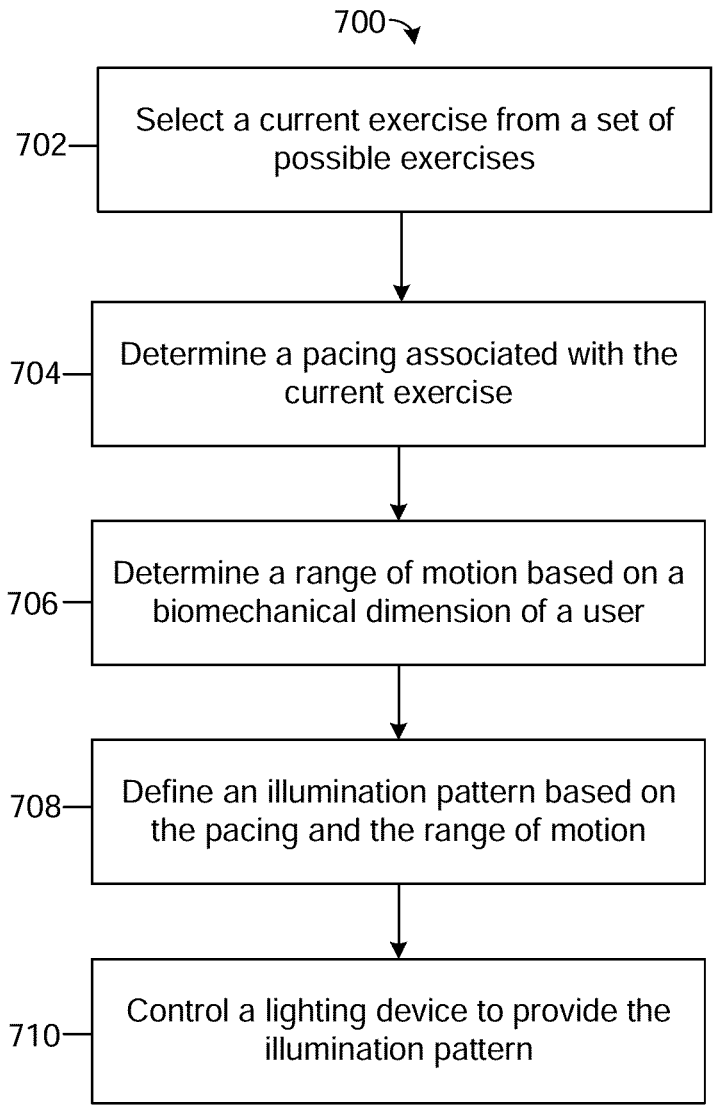
FIG. 7 is a flowchart of a process for user-customized control of a lighting device to guide performance of an exercise, according to an exemplary embodiment.

Referring now to FIG. 7, a flowchart of a process 700 for customizing control of the lighting device for a particular user is shown, according to an exemplary embodiment. The process 700 can be executed by the control system 400 of FIG. 4 in some embodiments.

At step 702, a current exercise is selected from a set of possible exercises. For example, a graphical user interface may be generated and provided to a user which shows a list of possible exercises and allows a user to select one of the possible exercises as the current exercise. As another example, a workout routine may be initiated which includes a sequence of exercises, such that the current exercise is selected when specified by the workout routine. A number of repetitions of the exercise to be performed may also be input by the user or determined from the workout routine.

At step 704, a pacing associated with the current exercise is determined. In some embodiments, pacings can be stored as a data objects, for example including numerical values for variables used to define the pacing (e.g., $\{T_{down}, T_{bottom}, T_{up}, T_{top}\}$) and associated with the possible exercises for selection. In such an embodiment, step 704 use a look-up table approach to obtain the pacing associated with the current exercise. In other embodiments, a user is prompted to input a desired pacing (e.g., to input durations for different phases of the exercise such as $T_{down}$, $T_{bottom}$, $T_{up}$, and $T_{top}$). In some such embodiments, step 702 can be omitted.

At step 706, a range of motion is determined based on a anthropometric dimensions of a user. The anthropometric measurements may be, for example, a height of the user, a length of a particular limb of the user (e.g., leg length, arm length), a length of a torso of the user, a length of a portion of a limb or other feature (e.g., a distance from a user's knee to the user's hip), a dimension based on a user's native range-of-motion (e.g., degree of flexibility), or some other physical dimension which affects the user's movement through an exercise. In some embodiments, different anthropometric measurements are used at step 706 depending on which exercise is selected. The anthropometric measurements can be acquired by the controller 402 via direct user input to a graphical user interface which prompts the user for such information. In other embodiments, the anthropometric measurements are determined automatically using data from the user tracking system 408. For example, video or images from a camera system may be processed to identify joints or other landmarks on a user and to determine the distance between such landmarks. In some such embodiments, the user may be prompted to perform one or more actions in view of the camera system to provide views and movements which facilitate measurement of the relevant dimensions. In some embodiments, a user profile storing one or more anthropometric measurements is stored on a user's personal computing device communicable with the controller 402 and/or at the remote server 404 to facilitate step 706 without requiring recalculation or reentry of anthropometric measurements at each use of the lighting device 120.

To determine the range of motion at step 706, a function may be used which maps a relevant anthropometric measurement to the range of motion. Different functions can be used for different exercises. For example, a standard squat exercise may take a user from full leg extension to ninety-degree flexion, such that a distance from the user's knee to the user's hip (or an approximation thereof, for example based on the user's height) can be used to define the range of motion. As another example, a deep squat exercise may be selected in which a user is desired to move to a lower position, such that a function may be used to add an additional distance to the distance from the user's knee to the user's hip to define the range of motion. Many such examples are possible.

In some embodiments, the range of motion determined at step 706 is defined in terms of an upper maximum position $P_{top}$ and a lower minimum position $P_{bottom}$, for example measured as distances above the platform 102 or other ground surface. In other embodiments, the range of motion determined at step 706 is defined as a single value which represents a distance between extremums of the range of motion, $D_{ROM}$.

At step 708, an illumination pattern is determined based on the pacing and the range of motion. For example, the illumination pattern may be determined by executing a program that provides the illumination pattern as a function of the pacing variables and range of motion variables discussed above (e.g., $F[t, \{P_{top}, P_{bottom}, T_{down}, T_{bottom}, T_{up}, T_{top}\}]$).

Step 708 can include mapping the range of motion defined at step 706 to particular positions on the lighting device 120. For example, in some embodiments, positions of the light sources 200 are known in the coordinate system used to define the upper maximum position $P_{top}$ and the lower minimum position $P_{bottom}$. In such embodiments, a direct mapping from the range of motion to the light sources 200 can be used to provide a one-to-one correlation between the user's physical range of motion and end points of the illumination pattern (e.g., end points 320, 322 of FIG. 3). The actual distance between the end points of the illumination pattern can then be substantially equal to the actual range of motion of the user. In some cases, alignment between a particular anatomical feature of the particular user (e.g., the user's eyes, the user's shoulders, the user's hips, etc.) and the illuminated end points for the illumination pattern on the lighting device 120 is achieved.

In other embodiments, the lighting device 120 is of a smaller or larger scale than the user's actual range of motion. In such embodiments, step 708 includes scaling the range of motion to define the end points of the illumination pattern based on the range of the motion for the particular user. For example, the distance on the lighting device 120 between end points of the illumination pattern can be defined as a preset fraction of the user's range of motion as defined in step 706 (e.g., equal to the distance $D_{ROM}$ multiplied by one-half).

At step 710, the lighting device is controlled to provide the illumination pattern. As discussed in detail above, this may include illuminating light sources 200 corresponding to endpoints of the range of motion and sequentially illuminating light sources 200 to create the illusion of movement of a pacing point along the lighting device between the end points of the range of motion.

Control of the lighting device at step 710 provides the user with visual guidance of a pacing and range of motion which is customized based on the selected, current exercise and a physical trait (e.g., anthropometric measurements) of the particular user. The lighting device thereby provides highly-intuitive guidance which the user can follow without requiring undue concentration or mental estimations of time or distance. Even in embodiments where the lighting device 120 is not of a scale to be mapped in a one-to-one scale to the user's range of motion, users learn to intuitively understand the mapping of the lighting to actual movement through repeated use of the lighting device 120. Control of the lighting device can thereby be highly-customized to provide a large amount of relevant information in a simple (e.g., one-dimensional) display which is easy for an athlete to process while under physical strain.

Referring now to FIG. 8, a flowchart of a process 800 for providing an indication of a tracked user position relative to the desired pacing for a selected exercise via a lighting device is shown, according to an exemplary embodiment. The process 800 can be executed by the control system 400 of FIG. 4 in some embodiments.

At step 802, an illumination pattern is provided via a lighting device. The illumination pattern is defined by oscillation of a first illuminated portion (pacing point) along the lighting device according to a preset pacing. Step 802 may be accomplished using the various approaches discussed above with reference to process 500, process 600, and process 700.

At step 804, a position of a user is tracked. That is, electronic data indicative of a user's position and movement over time is obtained at step 804. The user's position can be tracked using data from the user tracking system 408, for example. In some embodiments, the tracked position of the user is determined using a camera system, for example a stereoscopic camera system or an active tracking system. In some embodiments, the position of the user is tracked based on data from a wearable device affixed to the user (e.g., accelerometer data from a watch of the user). In yet other embodiments, the position of the user is tracked using data indicative of a position of an element of a resistance system which is being manipulated by the user to perform the exercise. For example, the multi-cable apparatus 100 may determine the position of the bar 104 based on a real-time configuration of the actuator assemblies, cables, and pulleys of the multi-cable apparatus 100 to both facilitate control of the actuator assemblies and to provide data indicative of the user's position for performance of step 804. Various approaches to determining a tracked user position at step 804 are possible.

At step 806, a location on the lighting device associated with the tracked position of the user is determined. For example, a particular light source 200 or subset of light sources 200 may be determined as corresponding to the tracked position of the user. Step 806 may include determining the current tracked position of the user relative to a desired range of motion for the exercise, and then applying a coordinate transformation to calculate the corresponding position along the light source. In embodiments where the lighting device is scaled to a user's range of motion (e.g., as described with reference to FIG. 7), the relationship between the current tracked position of the user to a desired physical range of motion for the user can be used to map the tracked position of the user to a corresponding position on the lighting device. Although the user will preferably be at or between the end points of the range of motion for the current exercise for successful performance of the exercise, in some embodiments the user may have deviated from the desired range of motion such that the tracked position is outside the desired range of motion. In such a scenario, the position of the lighting device may be above an upper end point 320 of the illumination pattern or below a lower end point 322 of the illumination pattern.

At step 808, the lighting device is controlled to provide a second illuminated portion associated with the tracked position of the user. To continue the example from step 806, the lighting source(s) 200 determined in step 806 as corresponding to the tracked position of the user are controlled to illuminate to provide a visual indication of the user's current position. In some embodiments, the second illuminated portion may be provided in a different color, brightness, or blinking pattern, etc. relative to the first illuminated portion to allow a user to distinguish between the two portions even on a one-dimensional display as for the lighting device 120 shown in FIGS. 2-3. In other embodiments, the lighting device is configured to provide a second column of light sources which can represent the second illuminated portion along a separate axis from the first illuminated portion. In yet other embodiments, the lighting device is configured such that the first illuminated portion can be displayed as a first symbol (e.g., shape, character, icon) and the second illuminated portion can be displayed as a second symbol. Various embodiments which display relative positions of the first illuminated portion and the second illuminated portion are possible.

At step 810, the lighting device is controlled such that the second illuminated portion moves along the lighting device in accordance with changes in the traced position of the user. That is, steps 804, 806, and 808 can be repeatedly performed (e.g., at a high-enough frequency to appear as continuous during ordinary use) so that the second illuminated portion is updated in a substantially instantaneous manner (i.e., without perceptible lag during ordinary use). Movement of the second illuminated portion is thereby caused to follow actual movement of the user.

At step 812, an indication of whether the tracked position matches a desired position for the user is provided, based on whether the second illuminated portion aligns with the first illuminated portion. While the second illuminated portion is being updated over time in step 810, the illumination pattern of the first illuminated portion continues to be provided to show a desired pacing to the user as described for step 802. At any given point in time, the first illuminated portion indicates a target or goal for the tracked position of the user.

A gap between the second illuminated portion and the first illuminated portions indicates that the user is not in the desired position for that given point in time for the current exercise. For example, if the second illuminated portion is above the first illuminated portion, the gap indicates to the user that the user is physically above, in real space, the preferred position for completing the exercise with proper pacing and form. The size of the gap indicates how far the user is from the preferred position. The user can then move at an increased or decreased pace or in a particular direction in order to drive the second illuminated portion towards the first illuminated portion.

When the user has successfully moved into the desired physical position, the second illuminated portion (indicating the tracked position) will align with (e.g., overlap) the first illuminated portion (indicating the desired position). In such a case, the lighting device may be controlled to provide an indication of successful alignment. For example, a color of the overlapping point can be updated to indicate alignment. As one example, if the first illuminated portion is provided in blue, and the second illuminated portion is provided in yellow, the lighting device may be controlled to display a green portion where the first illuminated portion and the second illuminated portion overlap (i.e., the combination of the colors). As another example, a blinking or flashing effect may be used to indicate alignment. As another example, a brightness may be varied to indicate alignment. As another example, a separate indicator light may be provided with the lighting device which turns on or off depending on whether the first and second illuminated portions are aligned. In some embodiments, a speaker is included and an audible cue is emitted when alignment is achieved or lost.

Process 800 thereby results in the provision of visual cues to a user to show where the user is relative to where the user should be for proper performance of a selected exercise. This can be scaled to the particular user's physical dimensions as described for process 700. Accordingly, the lighting device can be controlled to provide a type of automated coaching which provides real-time feedback to a user. By trying to move the second illuminated portion to follow the first illuminated portion, the user will be driven into the preferred physical position (e.g., as pre-defined by an expert trainer). Over time and through multiple repetitions, the user can be trained to follow the proper pacing and range of motion for the exercise without the need for direct human coaching or human observation.

Additionally, the lighting device can uses the indications of step 812 and/or other features described herein to support gamification of exercise performance which can encourage users to follow desired pacings for exercises. Often, despite instructions to follow particular paces for various exercises, athletes often ignore such instructions in favor of a natural, relatively easy cadence when not being observed by a coach or trainer. The visual indications and cues provided by the lighting device, control system, and methods described herein can motivate and enforce the preferred exercise pacing during solo or unsupervised workouts.

Various embodiments beyond those described above are also within the scope of the present disclosure. For example, although the examples above are described with reference to a vertical orientation for the lighting device (corresponding to a vertical direction of a range of motion for an exercise), other directions can also be used. For example, the lighting device can be oriented horizontally in some embodiments to help guide performance of exercises that require horizontal movement. In some embodiments, the lighting device is mounted so as to be rotated (manually and/or via an actuator) to an angle which best corresponds to the direction of movement for a selected exercise. In some embodiments, a two-dimensional array of light sources or set of perpendicular one-dimensional lighting devices is used to guide movement in two degrees of freedom.

Although the examples disclosed above are focused on repetitive strength-training exercises, various applications are possible. The strength-training exercises contemplated may be body-weight-only exercises, free-weight exercises, conventional cable machine exercises, or exercises using an electronically-controlled resistance system as disclosed above. The lighting device could deployed in a group fitness class environment to guide multiple users through a shared cadence. The devices, systems, and methods described herein may be adaptable for use in physical therapy settings, for example to guide static or dynamic stretching movements. The pacing lighting system may be useful for guiding breathing cadence for yoga or meditation practice. The pacing lighting system may also be adapted for cycling (e.g., indoor spinning classes) to guide pedaling cadence and pedal stroke smoothness. This disclosure can also be adapted for use in automated coaching of other sports movements, for example golf stroke training, basketball shot form practice, or other related sports fundamentals. Many such implementations are within the scope of the present disclosure.

What is claimed is:

1. A strength training apparatus comprising:

a rack configured to hold a bar between exercises performed using the bar;

at least one light source coupled to the rack; and a controller communicable with the light sources and programmed to:

determine a desired range of motion for a current exercise; and control the at least one light source to display an illumination pattern based on the desired range of motion.

2. The strength training apparatus of claim 1, wherein the controller is configured to provide the illumination pattern based on tracking movement of a user or the bar.

3. The strength training apparatus of claim 1, comprising a cable coupled to the bar and a motor coupled to the cable, wherein the controller is programmed to:

control the motor to exert tension in the cable to provide force on a user during the exercises performed using the bar; and control the light sources based on data indicative of movement of the cable relative to the motor.

4. The strength training apparatus of claim 1, comprising a light emitting diode (LED) display comprising the at least one light source.

5. The strength training apparatus of claim 1, wherein the controller is further programmed to determine the illumination pattern based on a desired pacing for the current exercise, and to control the light sources to display the illumination pattern by:

sequentially illuminating the at least one light source such that an illuminated point moves along the at least one light source from a first end point to a second end point in a first amount of time; and sequentially illuminating the at least one light source such that the illuminated point moves along the at least one light source from the second end point to the first end point in a second amount of time.

6. The strength training apparatus of claim 1, comprising a camera coupled to the rack, wherein the controller is programmed to provide the illumination pattern based on data from the camera indicative of a user's movement relative to the desired range of motion.

7. The strength training apparatus of claim 1, further comprising a speaker, wherein the controller is programmed to cause the speaker to emit a sound responsive to alignment between a tracked user position and a desired user position, the desired user position based on the desired range of motion.

8. The strength training apparatus of claim 1, further comprising a wearable device, wherein the controller is programmed to provide the illumination pattern based on data from the wearable device.

9. A strength training apparatus comprising:

a rack configured to hold an exercise attachment between exercises performed using the exercise attachment;

light sources coupled to the rack;

a controller communicable with the light sources and programmed to:

determine a desired range of motion for a current exercise; and control the light sources to sequentially illuminate to display movement of the exercise attachment relative to the desired range of motion.

10. The strength training apparatus of claim 9, comprising the exercise attachment, a cable coupled to the exercise attachment, and a sensor configured to determine the movement of the exercise attachment by measuring movement of the cable coupled to the exercise attachment.

11. The strength training apparatus of claim 10, comprising a motor coupled to the cable, wherein the controller is programmed to control the motor to exert a force on the cable.

12. The strength training apparatus of claim 9, further comprising a camera coupled to the rack and configured to provide, to the controller, data indicative of the movement of the exercise attachment.

13. The strength training apparatus of claim 9, wherein the lights sources are an LED display.

14. A method of controlling light sources of a strength training apparatus, comprising:

determining a range of motion for a selected exercise;

obtaining tracking data indicative of actual movement of a user relative to the range of motion;

scaling the actual movement to a dimension of the light sources based on the range of motion; and sequentially illuminating the light sources to display the actual movement relative to the range of motion based on the scaling.

15. The method of claim 14, wherein determining the range of motion for the selected exercise is based on a physical dimension of the user.

16. The method of claim 14, wherein obtaining the tracking data comprises optically tracking, by a camera coupled to a rack of strength training apparatus, the user.

17. The method of claim 14, wherein obtaining the tracking data comprises determining, by an actuator assembly of the strength training apparatus, movement of at least one cable of the actuator assembly.

18. The method of claim 14, further comprising:

determining a desired pacing for the selected exercise; and sequentially illuminating the light sources further based on the desired pacing.

19. The method of claim 18, further comprising changing a color of at least one of the light sources responsive to a match between the desired pacing and the actual movement of the user as indicated by the tracking data.

20. The method of claim 14, further comprising receiving a user selection of the selected exercise via a graphical user interface via a console of the strength training apparatus comprising the light sources.

* * * * *